United States Patent [19]

Kipple et al.

[11] 4,063,532

[45] Dec. 20, 1977

[54] FLUIDIZED BED POWDER CHAMBER

[75] Inventors: Harry P. Kipple, Penn Hills; Roger J. Alke, Wexford; Charles E. Price, Upper St. Clair Township, Allegheny County, all of Pa.

[73] Assignee: Westinghouse Electric Corporation, Pittsburgh, Pa.

[21] Appl. No.: 653,989

[22] Filed: Jan. 30, 1976

[51] Int. Cl.[2] ..... B05C 19/02

[52] U.S. Cl. ..... 118/429; 118/DIG. 5

[58] Field of Search ..... 118/DIG. 5, 429, 400; 427/182, 185; 34/211, 232, 233

[56] References Cited

U.S. PATENT DOCUMENTS

| | | | |
|---|---|---|---|
| 2,310,894 | 2/1943 | Brusset | 118/DIG. 5 |
| 3,032,816 | 5/1962 | Zimmerli | 118/429 X |
| 3,167,454 | 1/1965 | Tompson | 118/DIG. 5 |
| 3,279,094 | 10/1966 | Blanton, Jr. | 34/233 |

*Primary Examiner*—Dorsey Newton
*Attorney, Agent, or Firm*—L. P. Johns

[57] ABSTRACT

A fluidized bed system characterized by a fluidized bed chamber for coating objects dipped therein, the chamber having a bottom surface through which pressurized air is diffused uniformly throughout the cross sectional area of the chamber, and means for controlling the volume of air to effect a smooth suspended powder condition within the chamber during operation.

2 Claims, 4 Drawing Figures

FLUIDIZED BED POWDER CHAMBER

CROSS REFERENCE TO RELATED APPLICATION

This application is related to the copending application of Harry P. Kipple, Charles E. Price, Roger J. Alke, J. R. Coppage, and B. J. Sturman, Ser. No. 653,990, filed Jan. 30, 1976.

BACKGROUND OF THE INVENTION

1. Field of the Invention

A fluidized bed system for operating a uniformly suspended powder condition within the fluidized bed chamber, and more particularly, it pertains to a fluidized bed operation in which there is a flow of pressurized air in the amount of about 50 cubic feet per square foot.

2. Description of the Prior Art

Fluidized beds have gained wide acceptance for the purpose of applying resinous coatings to objects of a relatively small size having dimensions of up to about one foot. The objects usually have had relatively smooth surfaces without excessive cracks or crevices.

Where larger objects, such as a motor stator, are used, there is a problem of applying a smooth uniform surface to the many surfaces forming clearances between a plurality of spaced coils. The problem involves the provision of a fluidized bed chamber having a capacity greater than has been available heretofore. The use of such a fluidized bed chamber involves the use of a supply of pressurized air which creates a suspended powder of uniform density into which the object to be coated is placed.

SUMMARY OF THE INVENTION

In accordance with this invention it has been found that the foregoing problem may be overcome by providing a fluidized bed system suitable for applying heat-hardenable resinous coatings on an object, comprising a fluidized bed having bottom support means for supporting a powdered resinous material, a bottom support mmeans including a distribution chamber for distributing pressurized air, means for delivering pressurized air to the distribution chamber, the distribution chamber being coextensive with the cross sectional area of the fluidized bed and being divided into a plurality of smaller sectional chambers having upper sides facing the fluidized bed, the smaller sectional chambeer being intercommunicating with adjacent chambers, and the bottom support means comprising matted means on the distribution chamber for diffusing air substantially evenly over a cross sectional area of the fluidized bed, whereby the powdered resinous material in said reactor is suspended substantially evenly across the distribution chamber.

The advantage of the device of this invention is that resinous powder is suspended quietly and evenly within an upwardly rising volume of air uniformly across the cross sectional area of the fluidized bed.

DESCRIPTION OF THE PREFERRED EMBODIMENT

Figure 1:
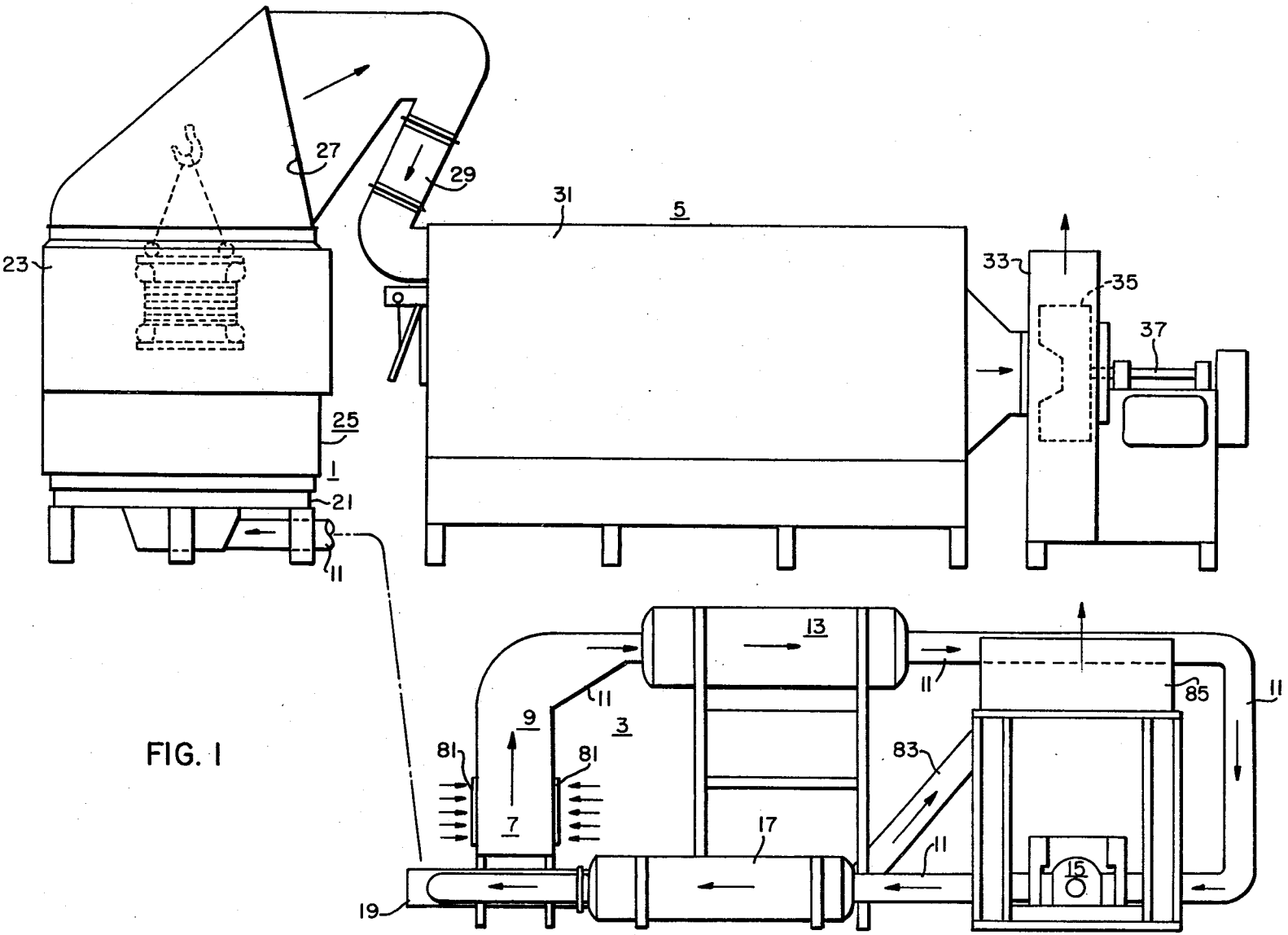
FIG. 1 is an elevational view of the fluidized bed system of this invention.
Figure 2:
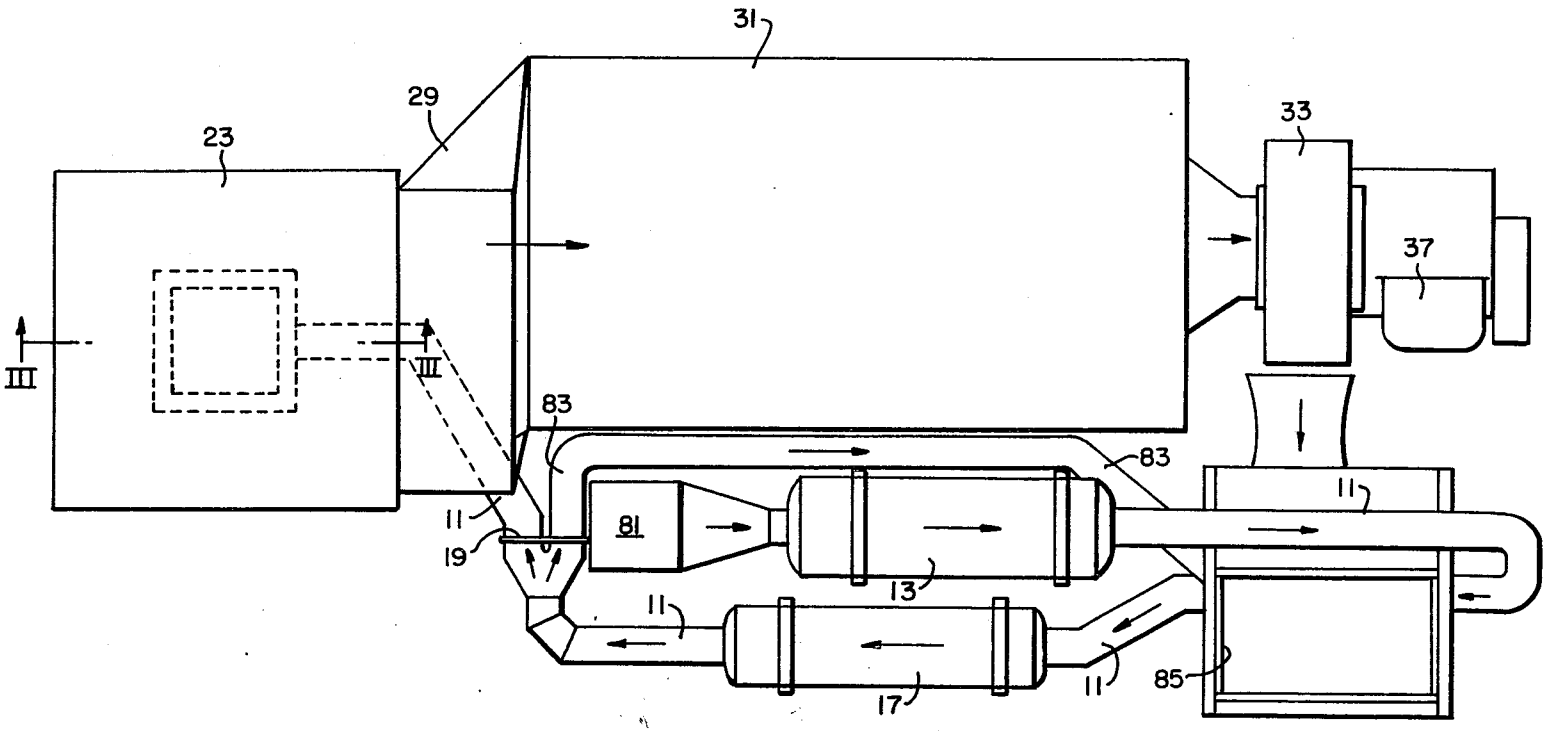
FIG. 2 is the plan view of the fluidized bed system.

The fluidized bed system of this invention is shown generally in FIGS. 1 and 2 and it comprises a fluidized bed 1, compressed air preparation means 3, and air conditioning means 5. Generally, ambient air is drawn into the system through an air intake 7 from where it is conducted through an air cooling coil 9 then through a conduit 11 and an inlet muffler 13 to a pump 15, and outlet muffler 17 and a control valve 19 from it moves to a manifold 21 (FIG. 3) below the fluidized bed 1.

The fluidized bed 1 comprises a tank or housing 23 forming a fluidizing bed chamber having a dimension of 62 inches wide, 62 inches high, and 62 inches deep. The top side of the tank 23 is opened and the bottom side is closed by bottom support means or member generally indicated at 25 in FIG. 3.

The air conditioning means 5 comprises an air exhaust vent 27 which sucks the mixture of air and powdered resin into a conduit 29 to a filter bag house 31 where particles of powdered resin are removed from the air. The filtered air enters an exhaust fan housing 33 from where it is emitted by a fan 35, driven by a motor 37 into the atmosphere.

Figure 3:
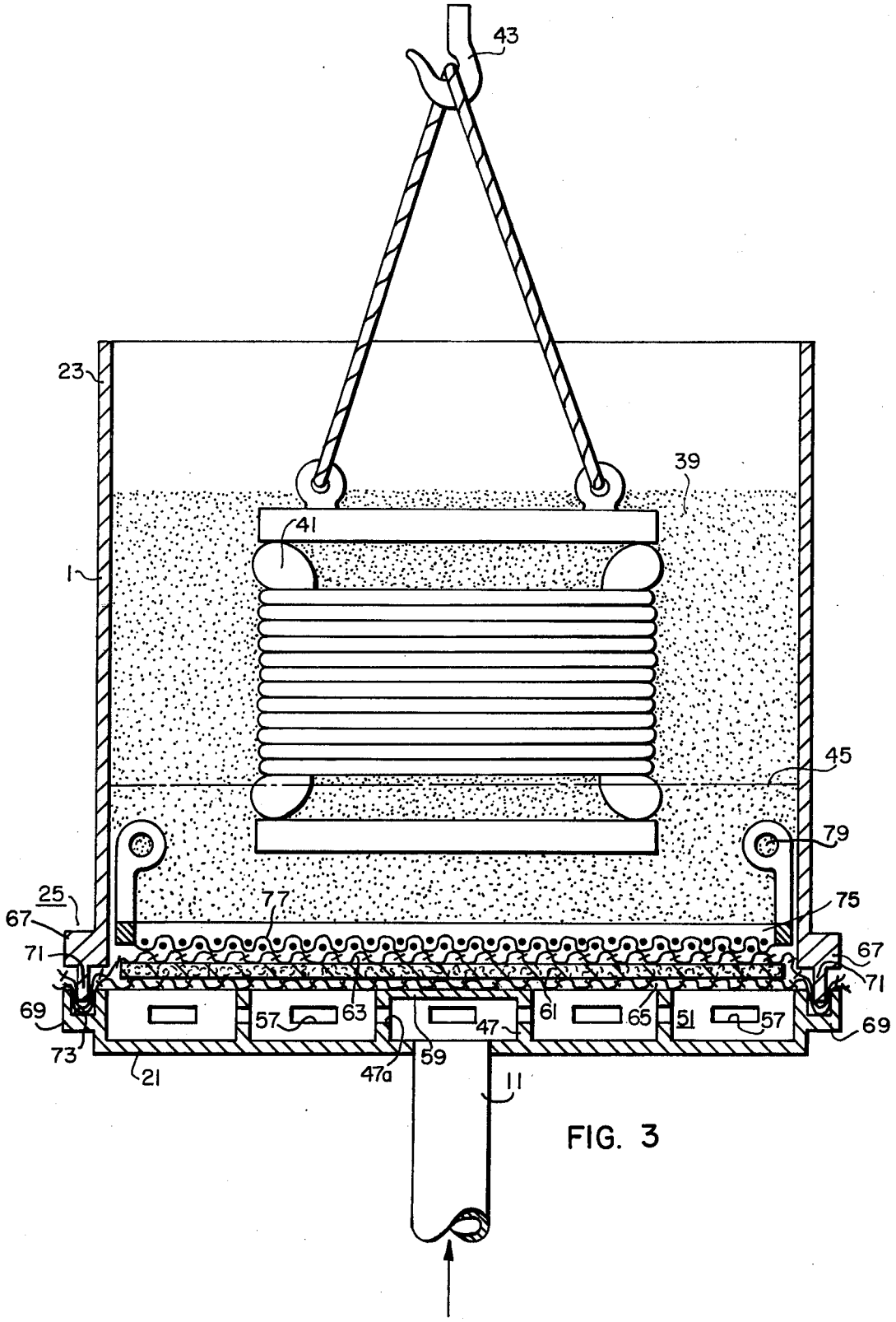
FIG. 3 is a vertical sectional view taken on the line III—III of FIG. 2.
Figure 4:
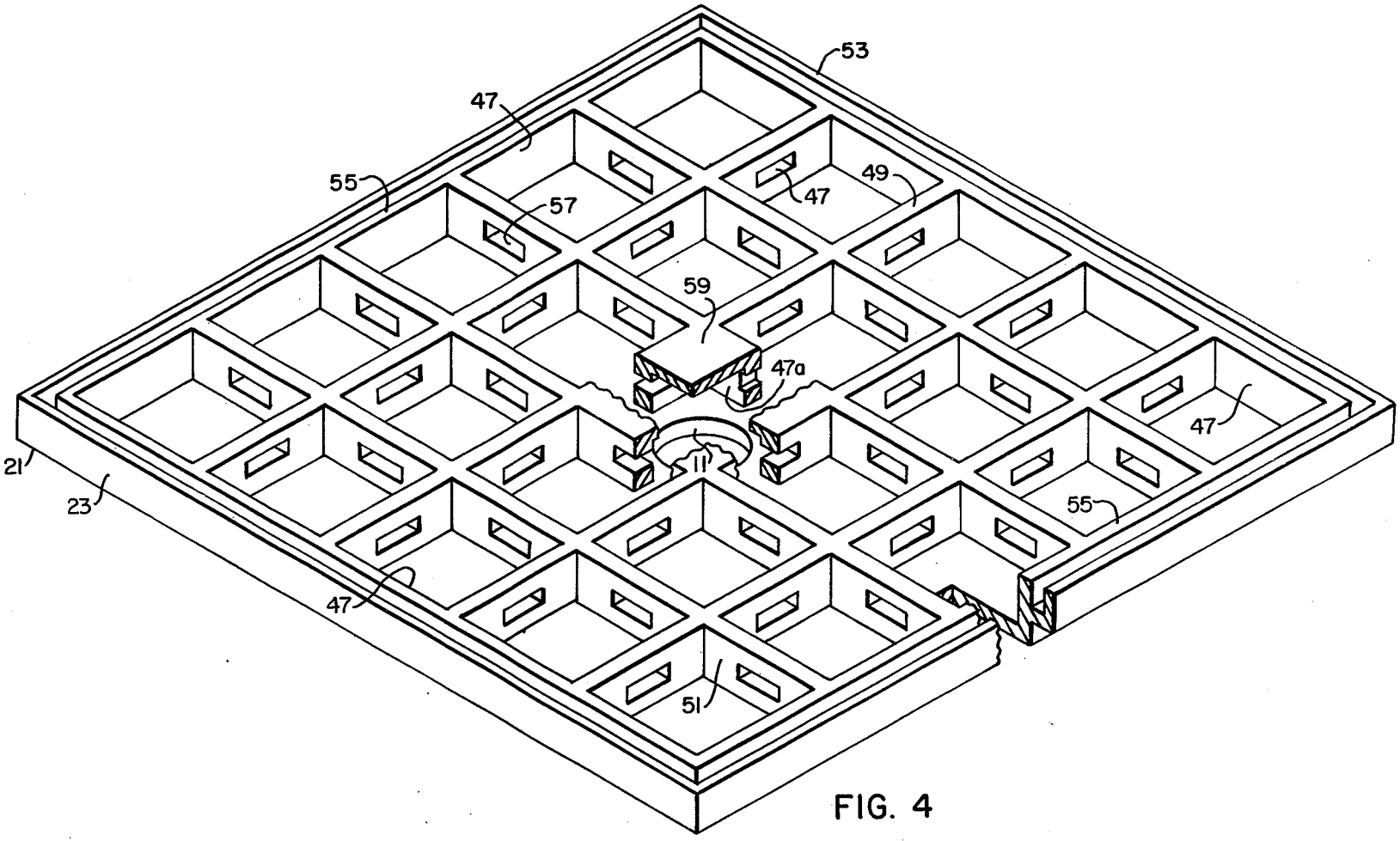
FIG. 4 is a perspective view of the distribution chamber for pressurized air.

As shown in FIG. 3, a mixture or bath 39 of air and powdered resin in contained within the tank 23 and, in the condition shown, the powdered resin is suspended within air to form a mixture of air and powder which rises to the level shown at 39, whereby it is ready for a dipping of an object 41 which may be suspended from a hook 43 of an overhead crane (not shown). When the fluidized bed 1 is not in use the air is turned off, causing the level of the mixture to drop from the level 39 to a level 45 which comprises a mass of powdered resin substantially devoid of air.

The mass of powdered material 45 is supported on the bottom member 25 which is porous to enable the upward movement of pressurized air, but is impervious to the particles of powdered resin. The bottom member 25 is supported by the manifold 21. As shown in FIG. 3, the manifold 21 is disposed at the upper end of the conduit 11 and includes a plurality of sectional chambers 47 which chambers are divided by a plurality of parallel spaced dividers 49 and 51 extending between outer peripheral walls 53 and 55. The portion of each divider 49, 51 enclosing each chamber 47 includes opening means or holes 57 by which communication between adjacent chambers is provided. Thus, all of the adjacent chambers 47 are in communication with a central chamber **47*a* which is directly connected to the upper end of the conduit 11 (FIG. 3) and the upper side of the central compartment 47*a* has a cover plate 59. Accordingly, pressurized air entering the chamber 47*a* from the conduit 11 is transmitted through the holes 57 to all of the interconnected chambers 47. From where the air rises vertically through the bottom member 25 to the fluidized bed chamber in the tank 23**.

The bottom member 25 comprises a pad 61 of matted material, such as felt, with at least one layer 63 of canvas on the top and preferably a second layer 65 of canvas on the bottom of the pad. The peripheral portions of the upper and lower layers 63 and 65 extend between flanges 67 and 69 which preferably include interfitting members, such as tongue 71 and groove 73, between which the peripheral portions of the canvas are clamped, whereby the pad 63 is completely enclosed in the canvas layers 63, 65. A basket 75, having a screen surface 77, is disposed above the canvas layer 63 and is provided with lifting hooks 79. The assembly of the pad 61 and the canvas layers 63, 65 provide for complete uniform distribution of the pressurized air rising upwardly from the several chambers 47. Thus, the air entering the lower portion of the tank 23 is applied uniformly throughout the mass of settled powdered resin having a level 45, and causes the resin to be evenly permeated with the air as it enters the tank, thereby gradually lifting and aerating the entire mass of the powdered resin unitl it is settled at the level 39 as previously described.

The lower layer 65 of the canvas is disposed upon the top edges of the spaced dividers 49, 51, and being porous, transmits the pressurized air to the pad 61 which in turn more evenly distributes the air over the entire cross sectional area of the tank 1. The upper layer 63 of canvas is sufficiently porous to transmit air, but prevents the powdered resin from permeating the pad 61 when a fluidized bed 1 is inoperative and the powdered resin settles to the level 45. The basket 75 and the screen surface 77 help to retain the assembly of the pad 61 and canvas layers 63, 65 in place and to maintain the pad and canvas layers in horizontal position against the pressure of the rising compressed air entering the tank 23 from the several sectional chambers 47.

During operation of the fluidized bed 1 when a heated object 41 is lowered into the bed, the powdered resin contacts the heated surfaces of the object and deposits thereon. At times, however, portions of the melted powder may accumulate in a particular area and drop off of the object to the bottom of the tank 23. Such portions of melted powder resin accumulate on the screen surface 77 and from time to time are removed by lifting the basket 75 with the hooks 79. In this manner melted portions of powdered resins are prevented from accumulating in the canvas 63 and the pad 61 and thereby otherwise reducing the effective surface of the pad and canvas from providing an evenly disposed airstream throughout the entire cross section of the tank 23.

The fluidized bed system of this invention is operated by starting the pump 15 to draw air through the air intake 7 which includes similar air filters 81. The air cooling coil 9 reduces the temperature of the incoming air to a temperature ranging between about 35° to 70° F thereby cooling the air and eliminating moisture. The mufflers 13 and 17 reduce noise created by the pump 15. Initially the control valve 19 is closed to the conduit 11 so that air is diverted to an exhaust conduit 83 (FIG. 2), which exhausts into an exhaust outlet 85. After the pump 15 operates sufficiently long for the air to obtain the desired temperature and low moisture content, the valve 19 is opened slowly to direct air into the manifold 21.

When air is first introduced into the fluidized bed 1, the valve 19 is opened partially so that a small volume of air enters the powdered resin. The longer the period of time that the fluidized bed 1 has not been used, the more compactly the powdered resin is settled at the level 45. For that reason more time is required to aerate the powder by introducing air gradually through the bottom of the fluidized bed. After applying the air over a period of time and gradually increasing its volume by opening the valve 19 to the completely open position, the powdered resin regains its powdered status, devoid of all lumps, with a mixture of uniformly disposed powder in air rising to a smooth quiet surface level 39 indicating that the fluidized bed 1 is ready for use.

Initially the air enters the manifold 21, spreads to the several chambers 47, and encounters resistance to flow upward by the pad 61 and canvas layers 63, 65. Gradually, however, the air works its way up through the pad and canvas layers and begins to lift the powder into a suspended condition. At first the powder has a boiling action due to fissures, crevices, or cracks in the compacted powder resin. The air is then vibrated by moving the valve between increased and decreased open positions to break up the settled powder until a preliminary boiling action subsides and settles to the smooth uniform suspended powdered condition at the level 39, whereby better penetration of the powder into the openings of the object 41 such as a motor stator.

The powdered resin has a melting point of from about 325° to 400° F so that the object to be coated is preheated to about 350° F. It is then submerged into the suspended powder for 5 to 10 seconds after which the object is removed and placed in an oven for an hour to cure the applied coating of resin. Where desirable, however, the object may be reheated in an oven and redipped in order to apply an additional coating before the object is finally placed in the oven for curing.

The resinous material used in this invention comprises an epoxy resin, an inorganic filler, and a coloring agent.

In conclusion, the fluidized bed system of this invention provides means for applying a coating of resinous material to the surface of objects, such as stator motors of up to 4000 volts capacity, with air pressure applied up to 3 pounds per square inch with about 50 cubic feet of air flow per minute. By providing a combination of valve means for varying the flow of air and an air porous matted bottom surface for the fluidized bed tank, air pressure may be applied to initially agitate settled powdered resin and to subsequently sustain the suspended powder resin in a uniformly distributed manner within the tank.

What is claimed is:

1. A fluidized bed system suitable for applying a heat-hardenable resinous coating on an object, comprising a fluidized bed having bottom support means for supporting a powdered resinous material, said bottom support means including a distribution chamber for distributing pressurized air, the distribution chamber being coextensive with the cross-sectional area of the fluidized bed and being divided into a plurality of adjoining rows of smaller sectional chambers having upper open sides facing the fluidized bed, each smaller sectional chamber having a common wall with an adjacent chamber of an adjoining row, each common wall being provided with opening means intercommunicating with said adjacent chamber to effect the transmission of pressurized air throughout, the undersurface of the fluidized bed being intercommmunicating with adjacent chambers, conduit means for delivering pressurized air to the distribution chamber, the conduit means communicating with one of the centrally located smaller sectional chambers, the bottom support means comprising felt pad means on the distribution chamber for diffusing air substantially evenly over the cross-sectional area of the fluidized bed, at least one side of the felt pad being covered with a canvas, whereby the powdered resinous material is suspended substantially evenly across the fluidized bed.

2. The fluidized bed system or claim 1 in which a grid-like member is disposed on the assembly of the felt pad and canvas.

* * * * *